US010538010B2

(12) United States Patent
Kicinski et al.

(10) Patent No.: US 10,538,010 B2
(45) Date of Patent: Jan. 21, 2020

(54) CUTTING DIE APPARATUS AND METHOD

(76) Inventors: Aaron Duke Kicinski, Rhome, TX (US); Gregory Dean Burger, Fort Worth, TX (US)

( * ) Notice: Subject to any disclaimer, the term of this patent is extended or adjusted under 35 U.S.C. 154(b) by 219 days.

(21) Appl. No.: 12/769,485

(22) Filed: Apr. 28, 2010

(65) Prior Publication Data

US 2011/0265620 A1 Nov. 3, 2011

(51) Int. Cl.
*B26D 7/18* (2006.01)
*B26F 1/38* (2006.01)
*B26F 1/40* (2006.01)

(52) U.S. Cl.
CPC ..... *B26D 7/1818* (2013.01); *B26D 7/18* (2013.01); *B26F 1/384* (2013.01); *B26F 1/40* (2013.01); *Y10T 83/0467* (2015.04); *Y10T 83/2109* (2015.04); *Y10T 83/2111* (2015.04)

(58) Field of Classification Search
CPC ..... B26D 7/18; B26D 7/1818; B26D 2007/1809; B26D 2007/189; Y10T 83/0467; Y10T 83/2109; Y10T 83/2111; Y10T 83/2155; Y10T 83/2157; Y10T 83/2133; Y10T 83/2163; Y10T 83/06; Y10T 83/21; Y10T 83/2105; B26F 1/384; B26F 1/40; B26F 1/38
USPC ..... 83/27, 117, 118, 138, 139, 142, 128; 493/82, 83, 342, 373, 472
See application file for complete search history.

(56) References Cited

U.S. PATENT DOCUMENTS 2,821,871 A * 2/1958 Sarno ..... 76/107.8
3,264,166 A * 8/1966 Lowery ..... 442/30
3,288,007 A * 11/1966 Masumi Eda et al. ..... 83/117
3,496,841 A * 2/1970 Kirby et al. ..... 493/468
3,552,244 A * 1/1971 Smith, Jr. ..... 83/863
3,705,526 A * 12/1972 Bishop ..... 83/698.31
3,765,329 A * 10/1973 Kirkpatrick et al. ..... 101/415.1
3,850,064 A 11/1974 Dwyer
4,306,476 A * 12/1981 Saunders et al. ..... 83/117
(Continued)

OTHER PUBLICATIONS

Darin M. Klemchuk, Letter dated Sep. 9, 2010 to David Reynolds at U.S. Steel Rule Dies, Inc. regarding the company's fabricating and selling of rotary cutting dies that include a product stabilizer, including Exhibit A, a picture of the product stabilizer marked with reference No. 26 claimed to be Applicant's invention, and request that company cease and desist from further use of product stabilizer.
(Continued)

*Primary Examiner* — Phong H Nguyen
(74) *Attorney, Agent, or Firm* — Kirby Drake

(57) ABSTRACT

Embodiments of the present disclosure generally provide a cutting die system. The cutting die system includes a substrate, at least one blade, and an ejector coupled to the substrate. The ejector includes a compressible portion having a top surface and a bottom surface opposite the top surface. The bottom surface is coupled to the substrate and a protective layer is cured to the top surface. A method of die cutting a blank according to an embodiment of the present disclosure includes directing a blank between a cutting die and an anvil, the cutting die comprising a substrate. An ejector coupled to the substrate is compressed between the cutting die and the blank. A scrap piece is cut from the blank as it passes between the cutting die and the anvil, and the scrap piece is ejected by releasing the compressed ejector.

15 Claims, 2 Drawing Sheets

(56) References Cited

U.S. PATENT DOCUMENTS

| | | | | |
|---|---|---|---|---|
| 4,499,802 | A * | 2/1985 | Simpson | 83/117 |
| 4,856,393 | A * | 8/1989 | Braddon | 83/50 |
| 5,111,725 | A * | 5/1992 | Simpson et al. | 83/117 |
| 5,176,613 | A | 1/1993 | Calvin et al. | |
| 5,179,882 | A | 1/1993 | Takeuchi et al. | |
| 5,512,233 | A * | 4/1996 | Gallagher et al. | 264/321 |
| 5,881,620 | A | 3/1999 | Smithwick, Jr. et al. | |
| 6,280,373 | B1 * | 8/2001 | Lanvin | 493/227 |
| 6,925,918 | B1 * | 8/2005 | Bunge | 83/116 |
| 7,111,534 | B1 | 9/2006 | Simpson | |
| 2005/0115372 | A1 * | 6/2005 | Cavlin | 83/13 |
| 2010/0068499 | A1 * | 3/2010 | Kanagawa et al. | 428/318.6 |
| 2011/0203435 | A1 * | 8/2011 | Smithwick | 83/114 |

OTHER PUBLICATIONS

Michael M. Carlson, Letter dated Oct. 5, 2010 to Darin M. Klemchuk in response to above-cited NPL reference #1.

* cited by examiner

CUTTING DIE APPARATUS AND METHOD

TECHNICAL FIELD

The present disclosure generally relates to cutting dies, and more particularly to cutting dies with improved scrap and product ejection and stabilization during cutting.

BACKGROUND

Cutting dies are commonly used for producing a container or carton from corrugated board sheet material. These containers or cartons can be produced by flat dies or rotary dies. Rotary cutting dies are typically comprised of a pair of cooperating cylinders or drums. One of the cylinders includes a substrate having cutting blades or rules while the other provides a backing surface against which the cut is made.

Rotary cutting dies of the type described above are often employed to produce slots or cut away a scrap portion from the perimeter of a usable product portion of a blank sheet of corrugated board material as it is processed. As such, provisions for removing or stripping the severed scrap material from certain cutting blades and the processed blank should be provided. Otherwise, if not removed from the vicinity of the cutting die during the cutting process, the scrap material may collect around the cutting blades and, if not properly ejected, may end up being inadvertently combined with the usable product.

To assist in ejecting portions of the blank sheet, it is known in the art to position ejectors on cutting dies. Examples include U.S. Pat. No. 5,881,620 ("Smithwick") and U.S. Pat. No. 7,111,534 ("Simpson"). In addition, U.S. Pat. No. 5,176,613 and U.S. Patent Application Publication No. 2005/0115372 (collectively the "Cavlin references") disclose a material positioned between the ejectors and the blank being cut. Although, the Cavlin references are silent as to if or how the material is attached to the ejectors, a product marked with the Cavlin patent number has material glued to the ejectors.

Ejectors may be positioned on the cutting die to eject different portions of the blank after it is cut, and product throughput may be improved if the ejectors can function properly at high speeds and be durable over many cycles without replacement.

SUMMARY

Embodiments of the present disclosure generally provide a cutting die system. The cutting die system includes a substrate and at least one blade coupled to the substrate. An ejector is also coupled to the substrate. The ejector includes a compressible portion having a top surface and a bottom surface opposite the top surface. The bottom surface is coupled to the substrate and a protective layer is cured to the top surface.

Further embodiments of the present disclosure include a cutting die that includes a substrate with a first and second blade coupled to it. A first stabilizer and a second stabilizer are also coupled to the substrate. The first stabilizer is proximate the first blade and the second stabilizer proximate the second blade. The first stabilizer and the second stabilizer are positioned to contact a respective perimeter portion of a usable product portion of a blank during die cutting. The cutting die further includes a product ejector coupled to the substrate. The product ejector comprises a sheet of rubber that is positioned between the first stabilizer and the second stabilizer to contact a substantial portion of the usable product portion of the blank during die cutting. The product ejector extends from the substrate less than either the first or second stabilizer.

In one embodiment, the cutting die system of the present disclosure provides durable ejectors that may effectively crush and eject scrap material from the usable product after die cutting. The increased durability may be provided by a layer of protective material cured on a top surface of compressible material. A cutting die system employing ejectors in accordance with an embodiment of the present disclosure, may allow increased speed and a longer useful life of the cutting die system.

In an additional embodiment, the cutting die of the present disclosure may include a product ejector. The product ejector may stabilize a blank and hold it flat against an anvil. It may reduce or eliminate back folding, wrinkling, crush, and false scoring of the blank when die cutting. Such reduction or elimination may increase stacking strength and make the finished product more aesthetically pleasing. The product ejector may be particularly useful when cutting across the corrugation of the blank.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides durable and long lasting cutting dies. In particular, improving the durability and strength of its ejectors may significantly enhance the performance of a cutting die. The ejectors may be positioned at certain locations on the cutting die depending on the configuration and the features desired in the final usable product.

It should be understood that the diagrams shown in FIGS. 1-4 are for illustrative purposes only and that other suitable cutting die systems could be used in conjunction with or in lieu of the illustrated cutting die features according to embodiments of the present disclosure.

Figure 1:
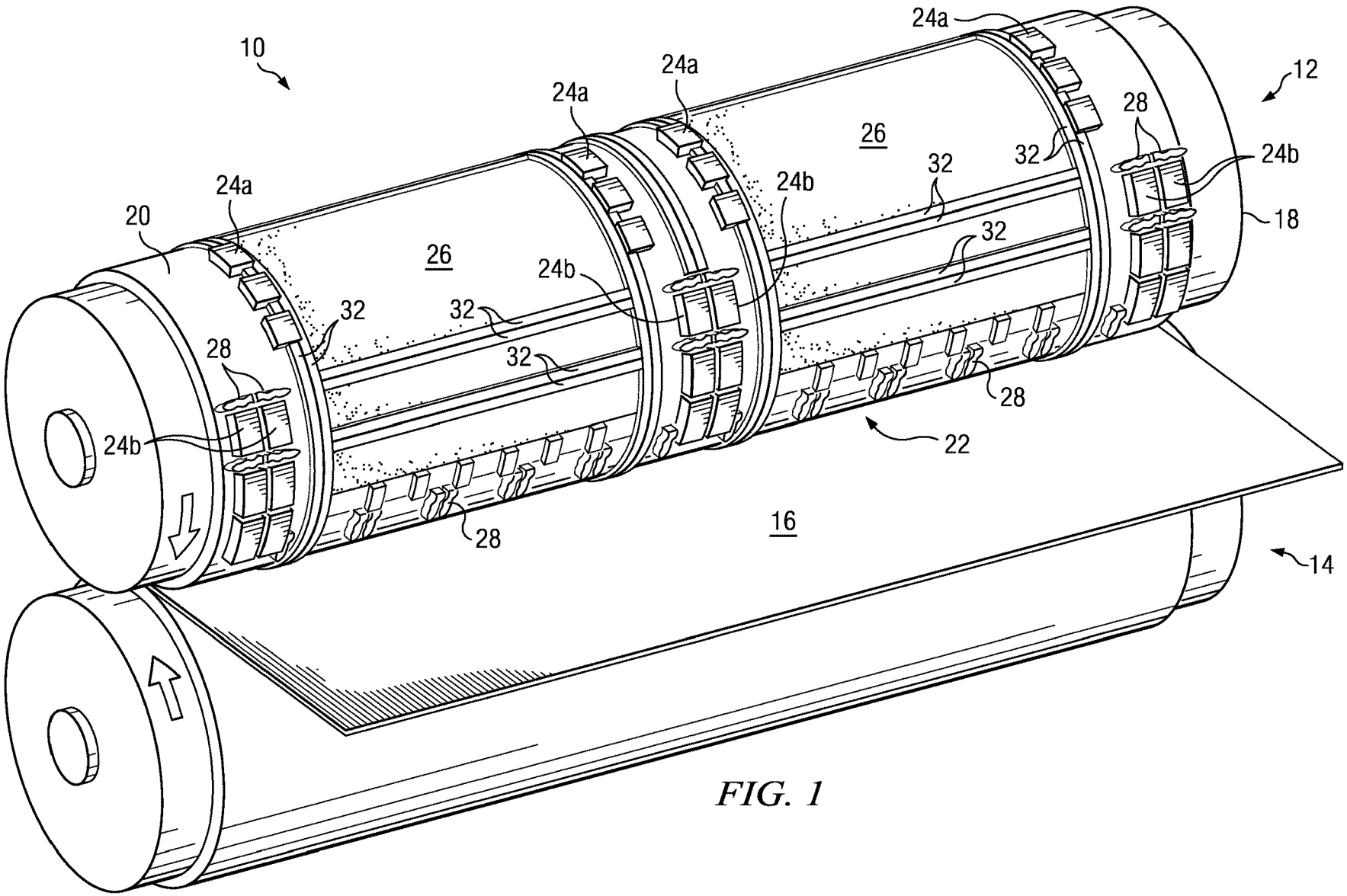
FIG. 1 is a perspective view of a rotary cutting die according to an embodiment of the present disclosure.

Referring to the drawings, and particularly to FIG. 1, a cutting die system 10 is shown. The cutting die system 10 includes a cutting die 12 and an anvil 14. The illustrated cutting die system 10 is a rotary die cutting system. However, the embodiments of the present disclosure are not limited to a rotary die cutting system, but rather may be employed with other types of cutting dies, for example a flat cutting die. The cutting die system 10 acts on a blank 16 to remove specific portions and create a usable product.

Examples of usable products that may be created using the cutting die system 10 include pizza boxes, shipping boxes, partitions, isle displays, countertop displays, and file boxes. The blank 16 may be a sheet of corrugated board or other paper product. The corrugated board or paper product may be made from recycled material or it may be an original raw paper product.

The anvil 14 may be a cylinder with a rubber material comprising its outer surface. This soft anvil 14 may provide a soft surface for the cutting die 12 to cut against. In operation, the cutting die and the anvil 14 may be disposed closely adjacent to each other and define a nip 22. The cutting die 12 and anvil 14 may rotate at approximately the same speed, and the blank 16 may be fed through the nip 22. As the blank 16 is fed through the nip 22, the cutting die 12 cuts through or scores the blank 16 against the anvil 14. Thus, the blank 16 is trimmed, scored, slotted, etc. to produce a finished usable product, and scrap material may be ejected away from the usable product where it may be discarded.

The cutting die 12 may include a base or a substrate 20. In certain embodiments, the substrate may be wood, while in others it may be metal or plastic or other synthetic material. The substrate 20 may be secured to the cylinder 18 with any suitable fastener; for example, the substrate 20 may be bolted to the cylinder 18.

In certain embodiments, an array of blades 30 may be secured to the substrate. (The blades 30 are not visible in FIG. 1 but can be seen in FIG. 4). The blades 30 may be secured in slots that have been burned in the substrate 20 with a laser as is known in the art. The blades 30 may be operable to cut material external or internal to a portion of the blank 16 making up the finished usable product. The blades 30 may be approximately one inch in width. In this configuration, the blades 30 that cut completely through the blank 16 may be sunk into the slots in the substrate 20 approximately ½ inch and still extend beyond the substrate 20 approximately ½ inch. The blades 30 may also be configured to score the blank 16, as opposed to cutting completely through it. A scored area may be easier to fold to create a container-type product, such as a pizza box.

Stabilizers 32 may be positioned on each side of the blade 30. In operation, the stabilizers 32 may hold the blank 16 during the cutting operation. The stabilizers 32 may be made of compressible and resilient rubber such that they compress when they contact the blank 16 against the anvil 14. This compression of stabilizers 32 may reveal a cutting portion of the blade 30 that may then cut the blank 16. The stabilizers 32 may be made of any suitable compressible and resilient material. In certain embodiments, the stabilizers 32 may be made of a low expansion elastomer, such as natural or synthetic rubber. The stabilizers 32 may extend approximately ½ to ⅝ inches beyond the substrate 20, which may be approximately even with to ⅛ of an inch beyond the blades 30.

Scrap ejectors 24 may also be secured to the substrate 20 in specific locations. Scrap ejectors 24 may also serve to hold the blank during the cutting operation and may be functional to eject the scrap material and separate it from the usable portion of the blank 16. Because scrap ejectors 24 may contact the discarded portion of the blank 16, they may have certain properties that allow them to crush the blank 16 during die cutting, whereas such properties may not be advisable to ejectors or stabilizers positioned to come in contact with the usable product portion of the blank 16. The scrap ejectors 24 may include interior scrap ejectors **24*a* and exterior scrap ejectors 24*b*. Similar to the blades 30, the interior scrap ejectors 24*a* may contact material internal to the portion of the blank 16 making up the finished product, and exterior scrap ejectors 24*b* may contact material of the blank 16 external to the portion of the blank 16** making up the finished product.

As used herein, "interior" may generally refer to a feature positioned on the cutting die 12 to contact material internal to the portion of the blank 16 making up the finished product, and "exterior" may generally refer to a feature positioned on the cutting die 12 to contact material external to the portion of the blank 16 making up the finished product.

A product ejector 26 may also be secured to the substrate according to an embodiment of the present disclosure. In certain embodiments, the product ejector 26 may be located between interior stabilizers 32, or the stabilizers 32 may be glued on the top surface of the product ejector 26. In operation, the product ejector 26 may contact the portion of the blank 16 that will become the usable product. This contact may allow the usable product portion of the blank 16 to be ejected after passing through the cutting die system 10. The product ejectors 26 may reduce or eliminate back folding, wrinkling, and false scoring of the blank 16. Back folding, wrinkling, and false scoring may be more likely to occur on cross corrugated runs, hot board runs, or when the blank 16 is imperfect, such as when it is warped.

The product ejector 26 may be comprised of a material that is compressible and resilient. In certain embodiments, the product ejector 26 may be a sheet of 10-30 durometer closed-cell, low-density natural or synthetic rubber affixed or glued to the substrate 20. The product ejectors 26 may have a thickness that is less than the stabilizers 32 and less than the scrap ejectors 24. In certain embodiments, the product ejector 26 may have a thickness of approximately ⅛ to ⅜ inches. Having the product ejector 26 contact a substantial portion of the blank 16 that is to become the usable product may have certain advantages over conventional die cutting systems. For example, the product ejector 26 may stabilize the blank 16 and hold the blank 16 flat against the anvil 14. This may prevent a portion of the blank 16 from sticking to the blades 30. The product ejector 26 may reduce or eliminate back folding, wrinkling, crush, and false scoring of the blank when die cutting. Such reduction or elimination may increase stacking strength and make the finished product more aesthetically pleasing. The product ejector 26 may be particularly useful when cutting across the corrugation of the blank 16. The compressible and resilient properties of the product ejector 26 may also assist in ensuring that the usable product portion of the blank 16 is efficiently ejected from the cutting die system 10.

The cutting die 12 may also include trim ejectors 28. Trim ejectors 28 may have a scalloped top surface that may allow the trim ejectors 28 to be positioned closer to the blades 30, which may result in less trim material to be discarded. The trim ejectors 28 may be particularly useful when the cutting die system 10 is used for short trim runs. They also may be secured to the substrate 20 where slots are to be cut in the blank 16.

Figure 2:
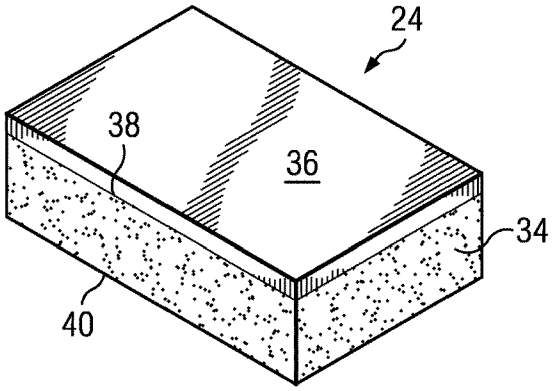
FIG. 2 is a detailed perspective view of an embodiment of an ejector shown in FIG. 1 according to the present disclosure.

FIG. 2 is a perspective view of one of the scrap ejectors 24 shown in FIG. 1. The scrap ejector 24 may be the interior scrap ejector **24*a* or the exterior scrap ejector 24*b* that is shown in FIG. 1. The scrap ejector 24 may include a compressible portion 34 and a protective layer 36. In certain embodiments, the protective layer 36 may be affixed to a top surface 38 of the compressible portion 34. A bottom surface 40 of the compressible portion 34 may be affixed to the substrate 20. In certain embodiments, the scrap ejector 24** may be glued to the substrate 20. The scrap ejector 24 may be secured to the substrate 20 in a location to allow it to contact the scrap portion of the blank 16. The compressible portion may comprise any suitable material that is compressible and resilient. For example, in certain embodiments, the compressible portion may comprise 40-90 durometer closed-cell, high-density, natural or synthetic rubber. The interior scrap ejector 24*a* may have a 55-90 durometer, while the exterior scrap ejector 24*b* may have a 40-55 durometer.

The compressible portion 34 may be firmer than, for example, the stabilizers 32 because the scrap ejectors 24 may crush the scrap material because it will not become part of the usable product. In contrast, the stabilizers 32 and the product ejector 26 may be less firm than the compressible portion 34 of the scrap ejector 24 because they should contact and stabilize the usable portion of the blank 16, but they should not crush or otherwise damage the usable portion of the blank 16. To assist the crushing of the scrap, the compressible portion 34 of the scrap ejector 24, may also be thicker than the stabilizers 32 and the product ejector 26. For example, the overall thickness of the scrap ejector 24 in some embodiments may range from ⅝ to ⅞ inches, which may be the distance the scrap ejector 24 extends from the substrate 20. The scrap ejector 24 may extend ⅛ to ⅜ inches beyond the blades 30 that completely through the blank 16. Because of the increased thickness and increased firmness of the scrap ejector 24, it may be subjected to increased forces during operation, and thus a protective layer 36 may increase the durability of the scrap ejector 24 and allow operation of the cutting die system 10 at higher speeds.

As illustrated, the thickness of the scrap ejector 24 may include a first thickness of the compressible portion 34 and a second thickness of the protective layer 36. In certain embodiments, the combined thickness of the compressible portion 34 and the protective layer 36 may be from ¾ to 1 inch. Because of the improved durability provided by the protective layer 36, scrap ejectors 24 may be a significant improvement over conventional scrap ejectors where a thin sheet of PVC plastic may come unglued and separate from a rubber portion. In contrast, according to an embodiment of the present disclosure, the protective layer 36 may be approximately 1/16 to ¼ inches thick. For example in certain embodiments, the protective layer 36 may be ⅛ inches thick.

According to an embodiment of the present disclosure, the protective layer 36 may be cured to the top surface 38 of the compressible portion 34. This curing process may allow the protective layer 36 to be bonded to the compressible portion 34 without using any additional adhesive. The curing process may also allow the protective layer 36 to flex with the compressible portion 34 without separating from it when the compressible portion 34 is compressed. Thus, at increased operating speeds of the die cutting system 10 and after many millions of cycles, the protective layer 36 may still be bonded to the compressible portion 34.

In certain embodiments, the protective layer 36 may include a thermoset or cured thermosetting polymer. Curing may occur as a result of a reaction of a resin with a hardener. In certain embodiments, the protective layer 36 may include a polyurethane resin, a color component, and an iso-hardener. The protective layer 36 may initially be in a fluid form, such that it may be sprayed or otherwise applied as a fluid to the compressible portion 34. Once it is applied to the top surface 38 of the compressible portion 34, it may then be cured. When the protective material is cured, it may toughen or harden due to cross-linking polymer chains in the protective layer 36. The curing process may transform the resin into a hardened or solid thermoset. The solid material may be formed because during the reaction, the molecular weight may increase to a point where the melting point of the protective layer 36 is higher than the surrounding ambient temperature. When the protective layer 36 is applied as a fluid to the compressible portion 34, the two materials may be in direct contact with each other and a strong bond may be formed directly between the protective layer 36 and the compressible portion 34 when the protective layer 36 is cured. This bond may be much stronger than a bond formed by applying glue or another type of adhesive between the protective layer 36 and the compressible portion 34.

Figure 3:
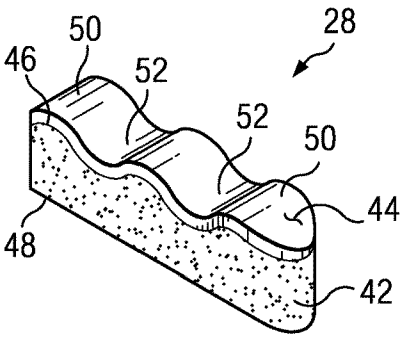
FIG. 3 is a detailed perspective view of a second embodiment of an ejector shown in FIG. 1 according to the present disclosure.

FIG. 3 illustrates a perspective view of a trim ejector 28 that is shown in FIG. 1. Similar to the scrap ejector 24, the trim ejector 28 may include a compressible portion 42 and a protective layer 44. In certain embodiments, the protective layer 44 may be affixed to a top surface 46 of the compressible portion 42. The top surface 46 of the compressible portion 42 may be scalloped, such that there are raised portions 50 and lower portions 52, as shown in FIG. 3. A bottom surface 48 of the compressible portion 42 may be affixed to the substrate 20 with any suitable joining technique such as an adhesive. The trim ejector 28 may be secured to the substrate 20 in a location proximate the blade 30 to allow it to contact the scrap portion of the blank 16 near a slot to be cut in the blank 16. The compressible portion 42 may comprise any suitable compressible and resilient material. For example, in certain embodiments the compressible portion may comprise low expansion natural or synthetic rubber.

In certain embodiments, when the raised portions 50 contact the blank 16 and are compressed during die cutting, the raised portions 50 can expand into the vacancy defined by the lower portions 52. Thus, in certain embodiments, the trim ejectors 28 may be placed nearer the blades 30, than might otherwise be advisable with conventional cutting dies. For example, in a conventional cutting die system, best cutting and ejection results may be achieved if the trim ejector is positioned approximately ⅜ inches away from the blades 30. In accordance with the teachings of the present disclosure, the distance the trim ejectors 28 may be placed away from the blades 30 may be reduced to ⅛ of an inch. This reduced distance may result in less trim being discarded as scrap, and it may also result in improved cutting and ejection of the trim portion of the blank 16.

Also similar to the scrap ejectors 24, the trim ejectors 28 may have a protective layer 44 cured to the top surface of the compressible portion 42. This curing of the protective layer 44 to the compressible portion 42 may be accomplished as described above with respect to the scrap ejectors 24. Thus, when the protective layer 44 is applied to the compressible portion 42, the two materials may be in direct contact with each other, and a strong bond may be formed directly between the protective layer 44 and the compressible portion 42 when the protective layer 44 is cured. This bond may be much stronger than a bond formed by applying glue or another type of adhesive between the protective layer 44 and the compressible portion 42. When the protective layer 44 is applied to the top surface 46, a scalloped protective layer 44 having raised and lower portions 50, 52 may result. The trim ejector 28 may allow a blank to be cut with a minimum width of scrap material being approximately ⅛ inches. The trim ejector 28 may also prevent the trim pieces of the blank 16 from being caught in the cutting die 12 proximate the blades 30.

Figure 4:
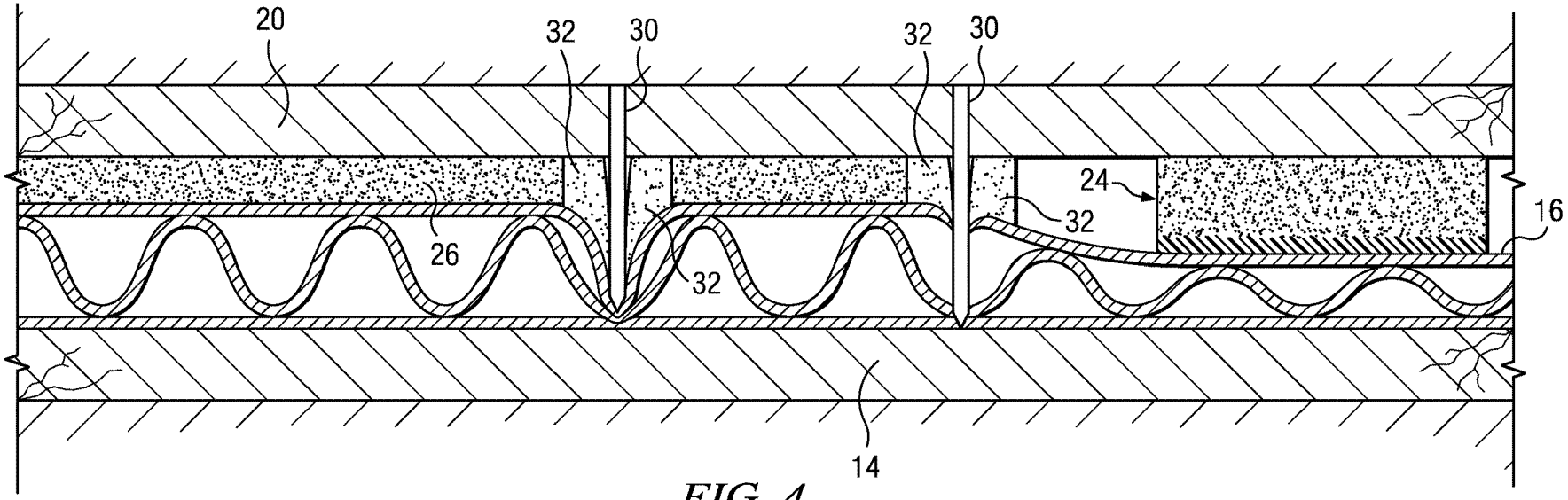
FIG. 4 is a sectional view of a cutting die shown cutting a blank according to an embodiment of the present disclosure.

FIG. 4 illustrates a sectional view of a portion of the cutting die system 10 of FIG. 1 during a cutting cycle. FIG.

4 also represents a portion of a flat cutting die in accordance with an embodiment of the present disclosure. As illustrated, the scrap ejectors 24 stabilize and may prevent the blank 16 from sliding between the scrap ejectors 24 and the anvil 14. The scrap ejectors 24 may also crush the scrap portion of the blank 16 by compressing the scrap flat against the anvil 14. Crushing the blank 16 may allow the scrap portion of the blank 16 to fall away from the usable portion of the blank 16, which is not crushed. Because the scrap ejectors 24 and the trim ejectors 28 include the protective layer 36, 44, the crushing function may be improved by allowing the compressible portions 34, 42 to have a higher density. The crushing and ejecting function may also be improved because of the greater overall thickness of the scrap ejectors 24 and trim ejectors 28. According to certain embodiments, more of the energy of the scrap ejectors 24 and trim ejectors 28 may go into crushing the blank that was previously possible with conventional ejectors on conventional cutting dies. Crushing the scrap may prevent ejected scrap pieces from floating and becoming intermingled with the usable product because the crushed scrap may fall to the ground faster than the uncrushed usable product after ejection. Moreover, the scrap ejectors 24 and the trim ejectors 28 may be more durable, which may allow higher rotation speeds and a longer useful life of the cutting die system 10.

In addition, during the cutting operation shown in FIG. 4, the stabilizers 32 may compress to approximately the same height as the product ejector 26. The product ejector 26 may stabilize the blank 16 by holding it flat against the anvil 14. The product ejector 26 may also keep the blank 16 from sticking to the blades 30 during cutting. Thus, if the usable portion of the blank 16 does not stick to the blades 30, particularly during high rotation speeds, ejection performance may be improved.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations, and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure and the following claims.

What is claimed is:

1. A rotary cutting die system for corrugated board comprising:

a cylindrical anvil;

a substrate secured to a rotary cutting die disposed adjacent to the cylindrical anvil; and one or more scrap ejectors coupled to the substrate to contact and crush a scrap portion of the corrugated board by compressing the scrap portion flat against the cylindrical anvil wherein upon crushing, the scrap portion falls away from a usable portion of the corrugated board that is not crushed, each of the one or more scrap ejectors comprising a compressible portion having a bottom surface affixed to the substrate and a protective layer cured to a top surface of the compressible portion, wherein the protective layer is cured directly to the top surface of the compressible portion such that no other adhesive material is between the compressible portion and the protective layer, and wherein the protective layer flexes with the compressible portion without separating from it when the compressible portion is compressed.

2. The rotary cutting die system of claim 1, wherein the protective layer comprises polyurethane.

3. The rotary cutting die system of claim 1, wherein the compressible portion comprises rubber having a durometer range of 40-90.

4. The rotary cutting die system of claim 1, wherein the protective layer has a thickness of approximately 1/16 to 1/4 inches.

5. The rotary cutting die system of claim 4, wherein the compressible portion has a thickness of approximately 1/2 to 3/4 inches.

6. The rotary cutting die system of claim 1, wherein a thickness of each of the one of more scrap ejectors is approximately 3/4 to one inch.

7. The rotary cutting die system of claim 1, wherein each of the one or more scrap ejectors extends approximately 1/8 to 3/8 inches beyond one or more blades coupled to the substrate, the one or more blades configured to cut completely through the corrugated board.

8. The rotary cutting die system of claim 7, wherein the one or more blades comprise a first blade and a second blade each coupled to the substrate, and the rotary cutting die further comprising:

a first stabilizer and a second stabilizer each coupled to the substrate;

the first stabilizer proximate a first blade and the second stabilizer proximate a second blade, the first stabilizer and the second stabilizer positioned to contact a respective perimeter portion of a usable product portion of the blank during die cutting; and a product ejector coupled to the substrate, the product ejector comprising a sheet of rubber, the product ejector being positioned between the first stabilizer and the second stabilizer and positioned to contact a substantial portion of the usable product portion of the corrugated board during die cutting, the product ejector extending from the substrate less than either the first stabilizer or the second stabilizer.

9. The cutting die of claim 1, wherein the top surface of the ejector includes a raised portion and a lower portion.

10. The rotary cutting die system of claim 1, the one or more scrap ejectors comprising:

one or more interior scrap ejectors that contact material interior to the portion of the blank comprising the finished product; and one or more exterior scrap ejectors that contact material of the blank external to the portion of the blank comprising the finished product.

11. The rotary cutting die system of claim 10, the one or more interior scrap ejectors having a 55-90 durometer and the one or more exterior scrap ejectors having a 40-55 durometer.

12. A rotary cutting die system, comprising:

a cylindrical anvil;

a substrate secured to a rotary cutting die disposed adjacent to the cylindrical anvil;

one or more blades coupled to the substrate;

one or more stabilizers positioned to contact a perimeter of a usable product portion of a blank during cutting;

one or more scrap ejectors coupled to the substrate to contact and crush scrap material by compressing the scrap material flat against the cylindrical anvil such that the scrap material falls away from the usable product portion of the blank that is not crushed, each of the one or more scrap ejectors comprising a compressible portion having a bottom surface affixed to the substrate and a protective layer cured to top surface of the compressible portion, wherein the protective layer is cured directly to the top surface of the compressible portion such that no other adhesive material is between the compressible portion and the protective layer; and a product ejector coupled to the substrate and the one or more stabilizers, the product ejector positioned to contact a substantial portion of the usable product portion of the blank during die cutting to reduce or eliminate back folding, wrinkling, and false scoring of the blank.

13. The rotary cutting die system of claim 12, wherein the product ejector comprises a sheet of low-density rubber.

14. The rotary cutting die system of claim 13, wherein the product ejector has a thickness between ⅛ to ⅜ inches and has a durometer range of 10-30.

15. The cutting die of claim 12, wherein the top surface of the ejector includes a raised portion and a lower portion.

* * * * *